US005090599A

United States Patent [19]

Stenger

[11] Patent Number: 5,090,599

[45] Date of Patent: Feb. 25, 1992

[54] SEAL FOR A BEVERAGE TAP

[75] Inventor: Tracy K. Stenger, Rockford, Ill.

[73] Assignee: Johnson Enterprises, Inc., Rockford, Ill.

[21] Appl. No.: 662,017

[22] Filed: Feb. 28, 1991

[51] Int. Cl.[5] ..... B67D 1/04

[52] U.S. Cl. ..... 222/400.7; 137/212; 137/317; 277/212 FB; 285/9.2; 285/409

[58] Field of Search ..... 222/320, 400.7, 400.8, 222/402.25, 542; 137/212, 322, 317; 277/212 FB; 251/149.6, 149.7; 285/45, 9.2, 409; 141/346, 392, 388; 403/344

[56] References Cited

U.S. PATENT DOCUMENTS

| | | | |
|---|---|---|---|
| 3,353,724 | 11/1967 | Johnston | 137/212 X |
| 4,026,316 | 5/1977 | Schots | 222/400.7 X |
| 4,305,421 | 12/1981 | Fallon | 137/212 X |
| 4,350,270 | 9/1982 | Nezworski | 222/400.7 X |
| 4,351,456 | 9/1982 | Nezworski | 222/400.7 X |
| 4,520,954 | 6/1985 | Brown | 222/400.8 |
| 4,665,940 | 5/1987 | Jacobson | 222/400.7 X |
| 4,711,377 | 12/1987 | Brown | 222/400.7 |
| 4,717,048 | 1/1988 | Stenger | 222/400.8 |
| 4,723,566 | 2/1988 | Lewins | 137/212 |

*Primary Examiner*—Michael S. Huppert
*Assistant Examiner*—Kenneth DeRosa
*Attorney, Agent, or Firm*—Leydig, Voit & Mayer, Ltd.

[57] ABSTRACT

A beverage tap includes a probe with a cylindrical upper section and a reduced-diameter cylindrical lower section. In order to seal the probe with respect to a Sankey-type keg fitting, an elastomeric seal includes a tubular body attached to the upper section of the probe and formed with a downwardly flaring sealing fin on its lower end. An apertured sealing disc is attached to the lower section of the probe and is located within the tubular body. Angularly spaced webs are molded integrally with the body and the disc and join the two together as a single unit.

11 Claims, 2 Drawing Sheets

SEAL FOR A BEVERAGE TAP

BACKGROUND OF THE INVENTION

This invention relates to a seal for a beverage dispensing tap and, more particularly, to a seal for a so-called Sankey-type beer tap. Such a tap includes a probe formed with one passage for admitting pressurized gas into a container and another passage for enabling beer to flow out of the container.

As the tap is attached to the container, the lower end of the probe engages and opens a valve in the container to permit beer in the container to flow into the beer passage of the probe. Shortly thereafter, a disc-like gasket spaced above the lower end of the probe engages and opens a second valve to enable pressurized air to flow into the container from the air passage of the probe. Engagement of the gasket with the second valve seals the beer passage from the air passage. Just prior to opening of the valves, a tubular sealing member on the probe engages the container to prevent beer from spewing past the probe until such time as the gasket is fully seated and sealed against the second valve. The tubular sealing member also prevents pressurized air from escaping from the container during use of the tap.

U.S. Pat. 4,717,048. In that tap, the tubular sealing member is a bellows-type seal and is formed separately of the gasket. As a result, two sealing components must be separately manufactured and stocked and must be separately assembled with the probe. Moreover, the bellows-type sealing member of the Stenger patent has virtually line contact with the container fitting around the outside surface of the sealing member and lacks firm radial support.

SUMMARY OF THE INVENTION

The general aim of the present invention is to provide, for a beverage tap of the above general type, a new and improved seal in which the tubular sealing member and the disc-like sealing gasket are formed as a unique single-piece unit so as to reduce the number of components which must be separately manufactured and assembled and thereby reduce the overall cost of the tap.

A more detailed object of the invention is to achieve the foregoing by molding the gasket integrally with the tubular sealing member and by joining the two with angularly spaced webs which permit pressurized air to flow into the container, the webs being uniquely shaped to allow the tubular member to establish a good seal.

The invention also resides in the novel shape of the tubular portion of the seal to enable the outer surface of the tubular portion to bulge into good surface contact with the container fitting to establish a reliable seal at two axially spaced locations and to establish good radial support for the seal.

These and other objects and advantages of the invention will become more apparent from the following detailed description when taken in conjunction with the accompanying drawings.

DETAILED DESCRIPTION OF THE PREFERRED EMBODIMENT

Figure 1:
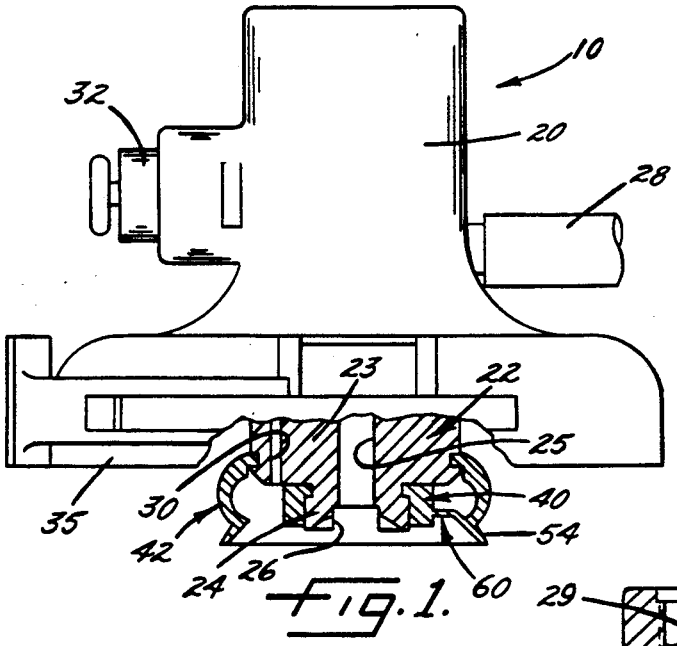
FIG. 1 is a side elevational view of a typical beverage tap equipped with a new and improved seal incorporating the unique features of the present invention.

For purposes of illustration, the invention has been shown in the drawings in connection with a tap 10 for dispensing beer or other beverage from a keg or the like. A fitting 12 (FIG. 2) is located at the top of the keg and, in this particular instance, is a fitting of the category which is known as a U.S. Sankey-type fitting. The fitting as such is well known and will be described only briefly herein. In general, the fitting includes a tubular neck 13 whose upper end portion projects upwardly from the keg and whose lower end portion is located in the keg. A ball seat 15 made of elastomeric material is normally urged upwardly to a sealed position against the lower end of the neck by a spring (not shown) and is adapted to be forced downwardly to an open position shown in FIGS. 2 and 5. The ball seat 15 receives a ball valve 16 which normally is urged upwardly to a closed position in the seat by a spring (not shown).

Figure 2:
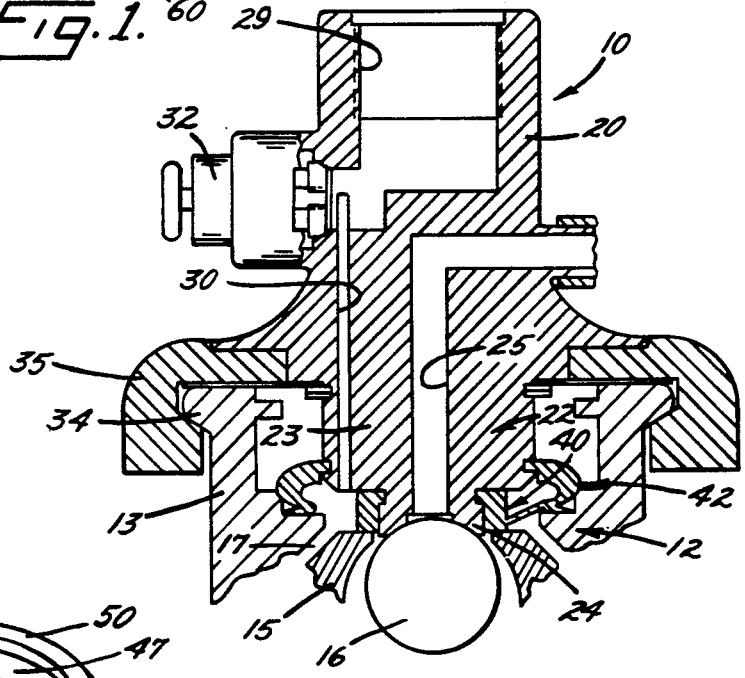
FIG. 2 is a cross-sectional view taken axially through the tap and shows the tap attached to a container.
Figure 5:
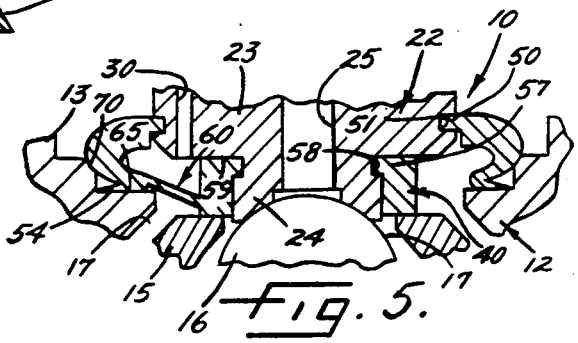
FIG. 5 is an enlarged fragmentary view showing certain components illustrated in FIG. 2.
Figure 6:
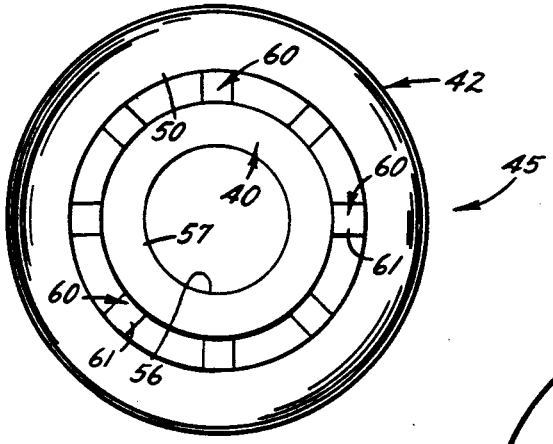
FIG. 6 is a top plan view of the seal.
Figure 7:
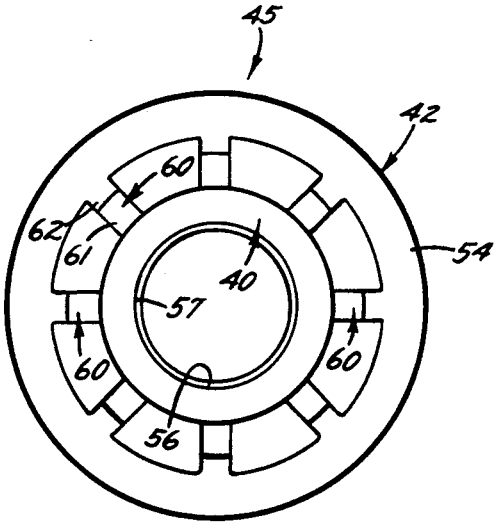
FIG. 7 is a bottom plan view of the seal.

When the ball 16 is forced downwardly away from the seat 15 to the position shown in FIGS. 2 and 5, beer is permitted to flow upwardly past the ball and out of the keg. Opening of the ball seat 15 from the lower end of the neck permits pressurized gas (either air or $CO_2$) to be introduced into the keg via an annular gap 17 in order to force the beer out of the keg.

The tap 10 includes a plastic body 20 (FIGS. 1 and 2) whose lower end carries a probe 22 having a cylindrical upper section 23 and a cylindrical but reduced-diameter lower section 24. A passage 25 is formed through the body 20 and the probe 22 and terminates as a cross-slot 26 (FIG. 1) at the extreme lower end of the probe. When the probe is forced downwardly into the neck 13, its lower end engages the ball 16 and forces the ball downwardly away from the seat 15 to its open position shown in FIGS. 2 and 5. Beer escapes past the open ball, flows into the cross-slot 26 and then flows through the passage 25 to a beer line 28 (FIG. 1) connected to the tap body 20 and carrying a dispensing faucet (not shown).

In the present instance, pressurized air is introduced into the keg by means of a hand-operated pump (not shown) whose lower end is adapted to be screwed into a threaded opening 29 (FIG. 2) in the upper end of the tap body 20. When the pump is operated, pressurized air is forced downwardly through a passage 30 (FIGS. 2 and 5) in the body 20 and flows into the keg by way of the annular gap 17 between the ball seat 15 and the lower end of the neck 13, the gap being closed by the spring-loaded ball seat when the tap is removed from the keg. A check valve (not shown) prevents beer from flowing into the pump while a relief valve 32 (FIGS. 1 and 2) in one side of the pump body prevents overpressurization of the keg.

As shown in FIG. 2, a radially outwardly extending peripheral lip 34 is formed around the upper end of the neck 13. The tap 10 includes a radially expandable and contractible camming collar 35 adapted to lock onto the lip to hold the tap 10 on the keg. The collar is disclosed fully in the aforementioned Stenger patent and need not be explained in detail here. It will suffice to say that, when the collar is contracted, it cams against the lower side of the lip 34 and forces the tap body 20 and the probe 22 downwardly relative to the fitting 12 so as to cause opening of the ball valve 16 and subsequent opening of the ball seat 15.

More specifically, downward movement of the probe 22 causes the extreme lower end of the lower section 24 of the probe to force the ball 16 to its open position. Thereafter, a disc or gasket 40 on the lower section 24 of the probe engages and seals against the ball seat 15 and forces the latter downwardly to its open position. In order to keep beer from leaking between the tap 10 and the fitting 12 between the time the ball 16 opens and the time the gasket 24 seals against the ball seat 15, the probe also carries a tubular sealing portion 42 which is adapted to seal against the inside of the neck 13 before the ball opens.

In accordance with the primary aspect of the present invention, the disc or gasket 40 and the tubular sealing portion 42 are formed as a single-piece component which may be assembled quickly and easily with the probe 22. The single-piece seal 45 which is thus formed by the integral gasket 40 and sealing portion 42 eliminates the need for multiple assembly operations and also reduces the number of components in the overall tap 10. In addition, the sealing portion 42 is uniquely shaped to seal more intimately with and to be firmly backed by the fitting 12.

More particularly, the tubular sealing portion 42 is in the form of a hollow upright body which is molded of a resiliently flexible and preferably elastomeric material such as 65 durometer rubber. The body 42 is circular in cross-section and, pursuant to the invention, is shaped such that its inner surface 47 (FIG. 4) is arcuately concave both circumferentially and axially while its outer surface 48 is arcuately convex both circumferentially and axially. The outer surface 48 of the body 42 is generally concentric with the inner surface 47.

Figure 3:
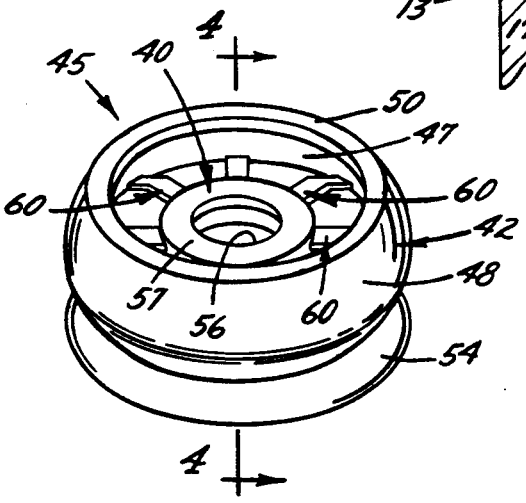
FIG. 3 is an enlarged perspective view of the seal.
Figure 4:
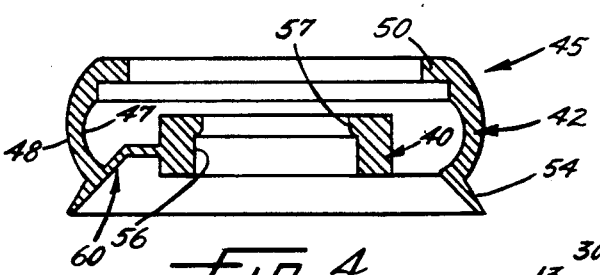
FIG. 4 is a cross-section taken substantially along the line 4—4 of FIG. 3.

Molded integrally with the upper end of the tubular body 42 is a radially inwardly projecting annular flange 50 (FIGS. 3 to 5). The flange telescopically receives the upper section 23 of the probe 22 and is adapted to snap into a circumferentially extending groove 51 (FIG. 5) formed around the outer side of the upper section. The flange 50 and the groove 51 coact to help hold the seal 45 in assembled relationship with the probe 22.

The body 42 of the seal 45 curves axially through just slightly less than 180 degrees. Formed integrally with and extending downwardly from the lower end of the body is a generally frustoconical sealing fin 54 (FIGS. 3 and 4). The sealing fin flares outwardly away from the body 42 upon progressing downwardly.

The gasket 40 is in the form of a circular washer formed with a vertically extending hole 56 (FIG. 4). The gasket is spaced radially inwardly from the inner surface of the body 42, is centered radially within the body and is located approximately midway between the upper and lower ends of the body. The lower section 24 of the probe 22 is sized to telescope into the hole 56 with a snug fit. To help hold the gasket on the probe, a radially inwardly extending flange 57 is formed integrally with the upper end of the gasket and snaps into a circumferentially extending groove 58 (FIG. 5) formed around the lower section 24 of the probe. The extreme upper end of the gasket abuts a downwardly facing shoulder 59 formed at the junction of the upper and lower sections 23 and 24 of the probe.

In keeping with the invention, the gasket 40 and the body 42 are joined to one another by a series of angularly spaced webs 60 which are molded integrally with the outer side of the gasket and the inner side 47 of the body. Herein, there are eight equally spaced webs. The spaces between adjacent webs define passages allowing pressurized air from the air passage 30 to flow into the keg via the gap 17 when the valve seat 15 is open.

Figure 8:
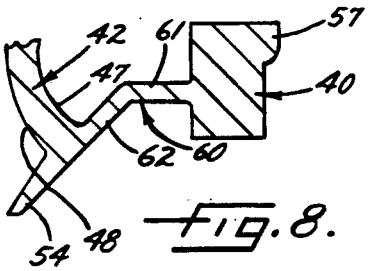
FIG. 8 is an enlarged cross-sectional view of part of the lower end portion of the seal and shows the seal in a relaxed condition.

Importantly, the webs 60 are shaped to facilitate axial collapse and radial expansion of the body 42 and deflection of the fin 54 as the probe 22 is inserted into the fitting 12. As shown most clearly in FIG. 8, each web 60 includes a radially extending section 61 which projects outwardly from the outer side of the gasket 40 just slightly below the vertical midpoint thereof. Formed integrally with the outer end of each radial section 61 is a downwardly and outwardly inclined section 62 whose lower end is joined to the inner surface 47 of the body 42 adjacent the upper end of the fin 54. When the seal 45 is relaxed, the inclined sections 62 of the webs 60 slope downwardly and outwardly at the same angle as the fin 54 as shown in FIG. 8.

Figure 9:
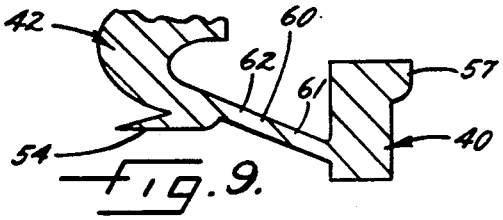
FIG. 9 is a view similar to FIG. 8 but shows the lower end portion of the seal in a deflected condition following tapping of the container.

With the foregoing arrangement, insertion of the probe 22 into the fitting 12 causes the lower end of the lower probe section 24 to engage and open the ball 16. Prior to engagement of the probe with the ball, the lower surface of the fin 54 engages and is stopped by an upwardly facing shoulder 65 (FIG. 5) defined in the fitting 12. With continued downward movement of the probe, the webs 60 deflect to the position shown in FIG. 9 to allow the probe to move downwardly relative to the fin. As the probe 22 moves further in a downward direction, the fin 54 deflects into a flattened condition as shown in FIG. 5 and seals against the shoulder 65 so as to prevent beer escaping between the ball 16 and the ball seat 15 from spewing outwardly between the probe 22 and the neck 13. Once the gasket 24 seals against the valve seat 15, spewing beer is no longer a problem but the seal established by the fin 54 forces pressurized air from the passage 30 to flow through the annular gap 17 and prevents such air from escaping outwardly between the outer side of the probe and the inner side of the neck 13.

When the fin 54 is stopped by the shoulder 54 but as the probe 22 continues downwardly, the body 42 of the seal 45 collapses axially and expands radially. Due to the concave shape of the inner surface 47 and the convex shape of the outer surface 48, the body collapses into an outwardly bulged and generally elliptical shape so as to cause the outer surface 48 to move into good surface contact with a surface 70 (FIG. 5) of the fitting 12. Such contact establishes a secondary seal that coincides in shape with the surface 70 and, in addition, establishes a firm radial backing for the body portion in that a relatively large area of the surface 48 engages the surface 70. Radial expansion of the body 42 thus is constrained so as to keep the fin 54 in tight sealing engagement with the shoulder 65.

From the foregoing, it will be apparent that the present invention brings to the art a new and improved seal 45 having an integrally formed gasket 40 and body portion 42 so as to enable the entire seal to be assembled with the probe 22 in a single operation. The unique shape of the body portion and the webs 60 allow the fin 54 to establish a tight and reliable seal each time the tap 10 is used.

I claim:

1. A beverage tap seal made from a single piece of resiliently flexible material, said seal comprising an upright tubular body of circular cross-section, said body having upper and lower ends and inner and outer surfaces, an annular flange formed integrally with the upper end of said body and projecting radially inwardly therefrom, a substantially frustoconical fin formed integrally with and extending downwardly from the lower end of said body, said fin flaring outwardly away from said body upon progressing downwardly, a disc located within said body between the ends thereof and spaced radially inwardly from the inner surface of said body, said disc having upper and lower ends and inner and outer sides and having an upright hole formed therethrough, and a series of angularly spaced webs formed integrally with and extending between the outer side of said disc and the inner surface of said body to join said disc to said body.

2. A seal as defined in claim 1 further including an annular flange formed integrally with the upper end of said disc and projecting radially inwardly into said hole.

3. A seal as defined in claim 1 in which the inner surface of said body is concavely curved both axially and circumferentially, the outer surface of said body being substantially concentric with the inner surface thereof and being convexly curved both axially and circumferentially.

4. A seal as defined in claim 1 in which each of said webs includes a generally radial portion extending outwardly from the outer side of said disc between the ends thereof and further includes an inclined portion extending downwardly and outwardly from said radial portion and joined to the inner surface of said body adjacent said fin.

5. A seal as defined in claim 4 in which the inclined portion of each web slopes downwardly and outwardly at substantially the same angle as said fin when said seal is relaxed.

6. A beverage tap seal made from a single piece of elastomeric material, said seal comprising an upright tubular body of circular cross-section, said body having upper and lower ends and inner and outer surfaces, said inner surface being concavely curved both axially and circumferentially, said outer surface being substantially concentric with said inner surface and being convexly curved both axially and circumferentially, an annular flange formed integrally with the upper end of said body and projecting radially inwardly therefrom, a substantially frustoconical fin formed integrally with and extending downwardly from the lower end of said body, said fin flaring outwardly away from said body upon progressing downwardly, a disc of circular cross-section centered radially within said body between the ends thereof and spaced radially inwardly from the inner surface of said body, said disc having upper and lower ends and inner and outer sides and having an upright hole formed therethrough, an annular flange formed integrally with the upper end of said disc and projecting radially inwardly into said hole, and a plurality of angularly spaced webs formed integrally with and extending between said disc and said body to connect said disc to said body, each of said webs having a generally radial portion extending outwardly from the outer side of said disc between the ends thereof and having an inclined portion extending downwardly and outwardly from the radial portion and joined to the inner surface of said body adjacent said fin.

7. The combination of, a beverage dispensing tap having a generally cylindrical probe, and a sealing member for establishing a seal around said probe during dispensing of beverage from said tap, said probe having an upper section with a first circumferentially extending groove and having a lower reduced-diameter section with a second circumferentially extending groove, said seal being made from a single piece of resiliently flexible material and comprising an upright tubular body of circular cross-section, said body having upper and lower ends and inner and outer surfaces, the upper section of said probe being telescoped into the upper end of said body, an annular flange formed integrally with the upper end of said body and projecting radially inwardly therefrom into said first groove to secure said body to said probe, a substantially frustoconical fin formed integrally with and extending downwardly from the lower end of said body, said fin flaring outwardly away from said body upon progressing downwardly, a disc located within said body between the ends thereof and spaced radially inwardly from the inner surface of said body, said disc having upper and lower ends and inner and outer sides and having an upright hole formed therethrough, the lower section of said probe extending through said hole and being telescoped into said hole with a snug fit, and a series of angularly spaced webs formed integrally with and extending between the outer side of said disc and the inner surface of said body to join said disc to said body.

8. The combination defined in claim 7 further including an annular flange formed integrally with the upper end of said disc and projecting radially inwardly into said second groove to help attach said disc to said probe.

9. The combination defined in claim 7 in which the inner surface of said body is arcuately concave both axially and circumferentially, the outer surface of said body being substantially concentric with the inner surface thereof and being arcuately convex both axially and circumferentially.

10. The combination defined in claim 7 in which each of said webs includes a generally radial portion extending outwardly from the outer side of said disc between the ends thereof and further includes an inclined portion extending downwardly and outwardly from said radial portion and joined to the inner surface of said body adjacent said fin.

11. The combination defined in claim 10 in which the inclined portion of each web slopes downwardly and outwardly at substantially the same angle as said fin when said seal is relaxed.

* * * * *